United States Patent [19]

Herbert

[11] Patent Number: 4,501,646

[45] Date of Patent: Feb. 26, 1985

[54] ELECTROFORMING PROCESS

[75] Inventor: William G. Herbert, Williamson, N.Y.

[73] Assignee: Xerox Corporation, Stamford, Conn.

[21] Appl. No.: 624,164

[22] Filed: Jun. 25, 1984

[51] Int. Cl.[3] ..... C25D 1/00; C25D 1/02

[52] U.S. Cl. ..... 204/4; 204/9

[58] Field of Search ..... 204/3, 4, 9

[56] References Cited

U.S. PATENT DOCUMENTS

| | | | |
|---|---|---|---|
| 3,844,906 | 10/1974 | Bailey | 204/9 |
| 3,876,510 | 4/1975 | Wallin | 204/9 |
| 3,905,400 | 9/1975 | Du Pree et al. | 138/140 |
| 3,927,463 | 12/1975 | Du Pree et al. | 29/447 |
| 3,947,348 | 3/1976 | Schabernack et al. | 204/9 |
| 3,950,839 | 4/1976 | Du Pree et al. | 29/447 |
| 3,963,587 | 6/1976 | Kreckel | 204/9 |
| 4,067,782 | 1/1978 | Bailey et al. | 204/25 |
| 4,326,928 | 4/1982 | Dugan | 204/9 |

FOREIGN PATENT DOCUMENTS

| | | | |
|---|---|---|---|
| 1018932 | 11/1977 | Canada | 204/9 |
| 1288717 | 9/1972 | United Kingdom | 204/9 |

*Primary Examiner*—Thomas Tufariello
*Attorney, Agent, or Firm*—Peter H. Kondo; John E. Beck; Ronald Zibelli

[57] ABSTRACT

An electroforming process comprising providing a core mandrel having an electrically conductive, adhesive outer surface, a coefficient of expansion of at least about $8\times10^{-5}$ in./in./°F., a segmental cross-sectional area of less than about 1.8 square inches and an overall length to segmental cross-sectional area ratio greater than about 0.6, establishing an electroforming zone between an anode selected from a metal and alloys thereof having a coefficient of expansion of between about $6\times10^{-6}$ in./in./°F. and about $10\times10^{-6}$ in./in./°F. and a cathode comprising the core mandrel, the cathode and the anode being separated by a bath comprising a salt solution of the metal or alloys thereof, heating the bath and the cathode to a temperature sufficient to expand the cross-sectional area of the mandrel, applying a ramp current across the cathode and the anode to electroform a coating of the metal on the core mandrel, the coating having a thickness at least about 30 Angstroms and stress-strain hysteresis of at least about 0.00015 in./in., rapidly applying a cooling fluid to the exposed surface of the coating to cool the coating prior to any significant cooling and contracting of the core mandrel whereby a stress of between about 40,000 p.s.i. and about 80,000 p.s.i. are imparted to the cooled coating to permanently deform the coating and to render the length of the inner perimeter of the coating incapable of contracting to less than 0.04 percent greater than the length of the outer perimeter of the core mandrel after the core mandrel is cooled and contracted, cooling and contracting the core mandrel, and removing the coating from the core mandrel.

15 Claims, 5 Drawing Figures

13
12
11
10
[Ni++] OZ./GAL.
0
.0001
.0002
HYSTERESIS IN./IN.

155
150
145
140
135
130
125
TEMPERATURE °F
0
.0001
.0002
HYSTERESIS IN./IN.

ELECTROFORMING PROCESS

BACKGROUND OF THE INVENTION

This invention relates in general to an electroforming process and more specifically to a process for electroforming hollow articles having a small cross-sectional area.

The fabrication of hollow articles having a large cross-sectional area may be accomplished by an electroforming process. For example, electrically conductive, flexible, seamless belts for use in an electrostatographic apparatus can be fabricated by electrodepositing a metal onto a cylindrically shaped mandrel which is suspended in an electrolytic bath. The materials from which the mandrel and the electroformed belt are fabricated are selected to exhibit different coefficients of thermal expansion to permit removal of the belt from the mandrel upon cooling of the assembly. In one electroforming arrangement, the mandrel comprises a core cylinder formed of aluminum which is overcoated with a thin layer of chromium and is supported and rotated in a bath of nickel sulfamate. A thin, flexible, seamless band of nickel is electroformed by this arrangement. In the process for forming large hollow articles having a large cross-sectional area, it has been found that a diametric parting gap, i.e. the gap formed by the difference between the average inside electroformed belt diameter and the average mandrel diameter at the parting temperature, must be at least about 8 mils and preferably at least about 10–12 mils (or 0.04–0.06 percent of the diameter of the mandrel) for reliable and rapid separation of the belt from the mandrel. For example, at a parting gap of about 6 mils, high incidence of both belt and mandrel damage are encountered due to inability to effect separation of the belt from the mandrel.

The parting gap is dependent upon the macro stress in the belt, the difference in linear coefficients of thermal expansion between the electroformed nickel and mandrel material and the difference between the plating and parting temperatures, in the following manner.

Parting Gap = Delta T $(\text{Alpha}_M - \text{Alpha}_{Ni})D - S \cdot D/E_{Ni}$ Greater or Equal 0.008 in.

wherein D is the diameter of the mandrel (inches) at plating temperature; S is the internal stress in the belt (psi) $E_{Ni}$ is Young's modulus for nickel; Delta T is the difference between the plating temperature and the parting temperature and $\text{Alpha}_M - \text{Alpha}_{Ni}$ are the linear coefficients of thermal expansion between the mandrel material (M) and the electroformed nickel (Ni).

One process for electroforming nickel onto a mandrel is described in U.S. Pat. No. 3,844,906 to R. E. Bailey et al. More specifically, the process involves establishing an electroforming zone comprising a nickel anode and a cathode comprising a support mandrel, the anode and cathode being separated by a nickel sulfamate solution maintained at a temperature of from about 140° F. to 150° F. and having a current density therein ranging from about 200 to 500 amps/ft$^2$, imparting sufficient agitation to the solution to continuously expose the cathode to fresh solution, maintaining this solution within the zone at a stable equilibrium composition comprising:

| | |
|---|---|
| Total Nickel | 12.0 to 15.0 oz/gal |
| Halide as $NiX_2.6H_2O$ | 0.11 to 0.23 moles/gal |

-continued

| | |
|---|---|
| $H_3BO_3$ | 4.5 to 6.0 oz/gal |

electrolytically removing metallic and organic impurities from the solution upon egress thereof from the electroforming zone, continuously charging to the solution about 1.0 to $2.0 \times 10^{-4}$ moles of a stress reducing agent per mole of nickel electrolytically deposited from the solution, passing the solution through a filtering zone to remove any solid impurities therefrom, cooling the solution sufficiently to maintain the temperature within the electroforming zone upon recycle thereto at about 140° F. to 160° F. at the current density in the electroforming zone, and recycling the solution to the electroforming zone.

The thin flexible endless nickel belt formed by this electrolytic process is recovered by cooling the nickel coated mandrel to effect the parting of the nickel belt from the mandrel due to different respective coefficients of thermal expansion.

As apparent in the disclosure of U.S. Pat. No. 3,844,906, a difference in the thermal coefficients of expansion of the electroformed article and mandrel is a vital factor in the electroforming process described therein for obtaining a sufficient parting gap to remove an electroformed article from the mandrel. For nickel belts having a diameter of about 21 inches, the difference in thermal coefficient of expansion between the electroformed article and the mandrel contributes about 60 percent to about 70 percent of the principal factors contributing to the formation of an adequate parting gap. The remaining 40 percent to 25 percent factor for an adequate parting gap for a belt of this size produced by the process of U.S. Pat. No. 3,844,906 is the internal stress (compressive) in the metal. This internal stress is controlled by stress enhancers or reducers and is independent of any differences in temperature. Typically, stress reducers are added to maintain a compressive condition. Sodium saccharin is added to the process described in U.S. Pat. No. 3,844,906 to control internal stress. However, differences in the thermal coefficients of expansion of the electroformed article and the mandrel contribute very little to the parting gap for hollow electroformed articles having a small cross-sectional area and stress reducers need not be used. Thus, for hollow electroformed articles having a relatively large cross-sectional area, the difference in the thermal coefficient of expansion of the electroformed article and the mandrel are significant and determine, for example, whether heating or cooling is necessary to secure the necessary parting gap. More specifically, nickel has a thermal coefficient of expansion of $8.3 \times 10^{-6}$ in/in/°F., aluminum has a thermal coefficient of expansion of $13 \times 10^{-6}$ in/in/°F., and stainless steel has a thermal coefficient of expansion of $8 \times 10^{-6}$ in/in/°F. When large diameter nickel articles are electroformed on mandrels of aluminum or aluminum coated with chromium, parting is assisted primarily by the difference in the thermal coefficients of expansion of the electroformed article and the mandrel when the assembly is cooled. However, when large diameter aluminum articles are electroformed on a stainless steel or nickel mandrel, heat must be applied to the assembly to assist parting. When large diameter nickel articles are electroformed on a stainless mandrel, the thermal coefficient of expansion of nickel is only slightly higher than that of stainless steel so that neither heating nor cooling of the assembly assists in removing the electroformed article from the mandrel.

However, when metal articles are fabricated by electroforming on mandrels having a small cross-sectional area, difficulties have been experienced in removing the electroforming article from the mandrel. For example, when the chromium coated aluminum mandrel described in U.S. Pat. No. 3,844,906 is fabricated into electroforming mandrels having very small diameters of less than about 1 inch, metal articles electroformed on these very small diameter mandrels are extremely difficult or even impossible to remove from the mandrel. Attempts to remove the electroformed article can result in destruction or damage to the mandrel or the electroformed article, e.g. due to bending, scratching or denting. Although aluminum has a relatively high thermal coefficient of expansion, such expansion is normally not great enough to impart a sufficient parting gap to allow removal of hollow electroformed articles from mandrels having a small cross-sectional area. Harder materials having high strength such as stainless steel have a significantly lower thermal coefficient of expansion than aluminum and would render even more difficult the removal of hollow small diameter electroformed articles therefrom. Although removal of an electroformed article depends to some extent on the characteristics of the mandrel such as smoothness, strength, length and coefficient of expansion, the diameter or cross-sectional area of the mandrel becomes the determining factor as to whether an electroformed article may be removed as the diameter or cross-sectional area of the mandrel becomes smaller and smaller. For large nickel belts, having a diameter of about 21 inches, the parting gap is about between 10 and 12 mils. For nickel cylinders having a diameter of about 3.3 inches, the parting gap is between about 2 and about 4 mils. As the diameter becomes smaller, for example about 1.75 inches, the parting gap drops to between about 1 and about 2 mils and the parting gap for a 1 inch diameter cylinder is about ½ mil. All of the above pertain to a nickel sleeve on a mandrel having a hollow aluminum core and chromium outer coating. Since the parting gap must be at least about 8 and preferably between about 10 to 12 mils and since a difference between the thermal coefficients of expansion of the mandrel and electroformed article are both nececessary for reliable and rapid separation of the mandrel as indicated in U.S. Pat. No. 3,844,906, it is readily evident that small diameter mandrels, even those having a high thermal coefficient of expansion, fail to function as suitable mandrels for electroformed articles having a small diameter or small cross-sectional area.

Accordingly, it is an object of this invention to provide an electroforming process which electroforms hollow articles having a small cross-sectional area.

It is another object of this invention to provide a process for electroforming hollow articles having a small cross-sectional area that are readily removable from mandrels regardless of whether a difference exists in the coefficients of expansion of the electroformed article material and the mandrel material.

It is still another object of this invention to provide a process for electroforming articles on mandrels having a thermal coefficient of expansion lower than the thermal coefficient of expansion of the electroformed article material.

It is another object of this invention to provide a process for electroforming an article on a mandrel in which the electroformed article has a thermal coefficient of expansion substantially equal to the thermal coefficient of expansion of the mandrel.

These as well as other objects are accomplished by the present invention by providing an electroforming process comprising providing a core mandrel having an electrically conductive, abhesive outer surface, a coefficient of expansion of at least about $8\times10^{-6}$ in./in./°F., a segmental cross-sectional area of less than about 1.8 square inches and an overall length to segmental cross-sectional area ratio greater than about 0.6, establishing an electroforming zone between an anode selected from a metal and alloys thereof having a coeficient of expansion of between about $6\times10^{-6}$ in./in./°F. and about $10\times10^{-6}$ in./in./°F. and a cathode comprising the core mandrel, the cathode and the anode being separated by a bath comprising a salt solution of the metal or alloys thereof, heating the bath and the cathode to a temperature sufficient to expand the cross-sectional area of the mandrel, applying a ramp current across the cathode and the anode to electroform a coating of the metal on the core mandrel, the coating having a thickness at least about 30 Angstroms and stress-strain hysteresis of at least about 0.00015 in./in., rapidly applying a cooling fluid to the exposed surface of the coating to cool the coating prior to any significant cooling and contracting of the core mandrel whereby a stress of between about 40,000 p.s.i. and about 80,000 p.s.i. are imparted to the cooled coating to permanently deform the coating and to render the length of the inner perimeter of the coating incapable of contracting to less than about 0.04 percent greater than the length of the outer perimeter of the core mandrel after the core mandrel is cooled and contracted, cooling and contracting the core mandrel, and removing the coating from the core mandrel.

Any suitable metal capable of being deposited by electroforming and having a coefficient of expansion of between about $6\times10^{-6}$ in/in/°F. and about $10\times10^{-6}$ in/in/°F. may be used in the process of this invention. Preferably, the electroformed metal has a ductility of at least about 8 percent elongation. Typical metals that may be electroformed include, nickel, copper, cobalt, iron, gold, silver, platinum, lead, and the like, and alloys thereof.

The core mandrel should be solid and of large mass or, in a less preferred embodiment, hollow with means to heat the interior to prevent cooling of the mandrel while the deposited coating is cooled. Thus, the mandrel has high heat capacity, preferably in the range from about 3 to about 4 times the specific heat of the electroformed article material. This determines the relative amount of heat energy contained in the electroformed article compared to that in the core mandrel. Further, the core mandrel should exhibit low thermal conductivity to maximize the difference in temperature (Delta T) between the electroformed article and the core mandrel during rapid cooling of the electroformed article to prevent any significant cooling and contraction of the core mandrel. In addition, a large difference in temperature between the temperature of the cooling bath and the temperature of the coating and mandrel maximizes the permanent deformation due to the stress-strain hysteresis effect. A high thermal coefficient of expansion is also desirable in a core mandrel to optimize permanent deformation due to the stress-strain hysteresis effect. Although an aluminum core mandrel is characterized by a high thermal coefficient of expansion, it exhibits high thermal conductivity and low heat capacity which are less effective for optimum permanent deformation due to the stress-strain hysteresis effect. Typical mandrels include stainless steel, iron plated with chromium or nickel, nickel, titanium, aluminum plated with chromium or nickel, titanium pallidium alloys, inconel 600, Invar and the like. The outer surface of the mandrel should be passive, i.e. abhesive, relative to the metal that is electrodeposited to prevent adhesion during electroforming. The cross-sectional configuration of the mandrel may be of any suitable shape. Typical shapes include circles, ovals, regular and irregular polygons such as triangles, squares, hexagons, octagons, rectangles and the like. For mandrels have a convex polygon cross-sectional shape, the distance across adjacent peaks of the cross-sectional shape is preferably at least twice the depth of the valley between the peaks (depth of the valley being the shortest distance from an imaginary line connecting the peaks to the bottom of the valley) to facilitate removal of the electroformed article from the mandrel without damaging the article and to ensure uniform wall thickness. The surfaces of the mandrel should be substantially parallel to the axis of the mandrel. Thus, the core mandrel should have a taper of less than about 0.001 inch per foot along the length of the core mandrel. This is to be distinguished from a core mandrel having a sharp taper which would not normally present any difficulties in so far as removal of an electroformed article from the mandrel. This taper, of course, refers to the major surfaces of the mandrel and not to an end of the mandrel which may also be covered by an electroformed deposit. The mandrel should have a segmental cross-sectional area of less than about 1.8 square inches and an overall to segmental cross-sectional area ratio greater than about 0.6. Thus, a mandrel having a segmental cross-sectional area of about 1.8 square inches would have a length of at least about 1 inch. Excellent results have been obtained with the process of this invention with a solid cylindrical core mandrel having a segmental cross-sectional area of about 0.788 square inch (1 in. diameter) and having a length of about 24 inches.

Surprisingly, an adequate parting gap may be obtained even for electroformed articles having a small diameter or small cross-sectional area by controlling the stress-strain hysteresis characteristics of the electroformed article. For example, sufficient hysteresis alone may be utilized to achieve an adequate parting gap to remove an electroformed article from a mandrel having a diameter of about 1.5 inches in the absence of any assistance from internal stress characteristics of the electroformed article or from any difference in thermal coefficients of expansion of the electroformed article and mandrel. The internal stress of an electroformed article includes tensial stress and the compressive stress. In tensial stress, the material has a propensity to become smaller than its current size. This is believed to be due to the existence of many voids in the metal lattice of the electroformed deposit with a tendency of the deposited material to contract to fill the voids. However, if there are many extra atoms in the metal lattice instead of voids, such as metal atoms or foreign materials, there is a tendency for the electroformed material to expand and occupy a larger space.

Stress-strain hysteresis is defined as the stretched (deformed) length of a material in inches minus the original length in inches divided by the original length in inches. The stress-strain hysteresis characteristics of the electroformed article fabricated by the process of this invention should be maximized about about 0.00015 in/in.

BRIEF DESCRIPTION OF THE DRAWINGS

A more complete understanding of the process of the present invention can be obtained by reference to the accompanying drawings wherein.

Figure 1:
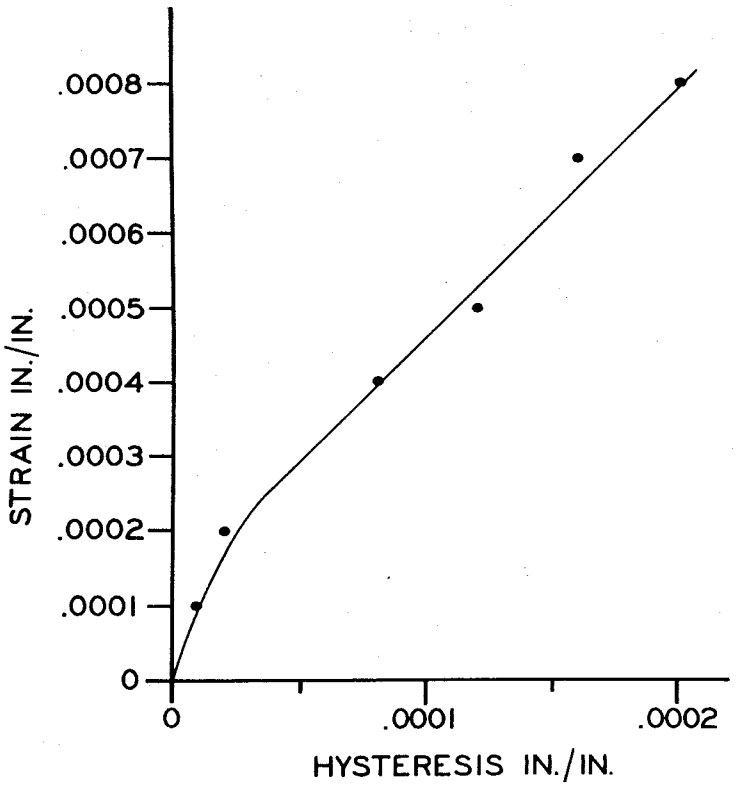
FIG. 1 graphically illustrates the relationship of strain on hysteresis.

Hysteresis plots for an electroformed article sample prepared with specific bath compositions, bath temperatures, degree of agitation and the like at a given difference in temperature may be charted using a tensial puller such as a Tucon tensial puller. Generally, a rectangular sample is cut from an electroformed article and placed in the tensial puller. The machine measures the pounds of stretching force applied to the sample, the distance that the sample is stretched, the stretching rate and the rate of application of stress. Thus, stress in pounds per square inch can be plotted against strain in inches per inch. Referring to the FIG. 1, a series of samples were placed in a tensial puller and stress plotted along the vertical axis and strain along the horizontal axis. Each point on the plot in FIG. 1 represents a different sample having its own individual stress-strain hysteresis characteristic which is different from the other samples. By increasing the application of stress and thereafter releasing the stress, one observes that each sample becomes permanently deformed and does not return to its original dimensions. The stress-strain hysteresis is the stretched length in inches subtracted from the original length in inches, the difference being divided by the original length in inches. Thus, the unit for a stress-strain hysteresis is in/in. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in. With sufficient stress-strain hysteresis, an adequate parting gap of about 0.0003 inch for a cylindrical solid core mandrel having a diameter of about 1.5 inches and a sufficient parting gap of about 0.00015 inch for a cylindrical solid core mandrel having a diameter of about 1 inch may be obtained to permit removal of electroformed articles thereon without damaging the electroformed articles or the mandrel. Thus, the process of this invention can effectively remove electroformed articles on a high heat capacity core mandrel without the necessity of destroying or damaging the core mandrel or heating the electroformed article during the removal step.

The hysteresis characteristics of a given electroformed material may be controlled by adjusting the electroforming process conditions and the composition of the electroforming bath. Control involves adjusting the pH, metal component concentration, bath temperature, speed of core mandrel rotation, and the like. With each adjustment, a hysteresis stress strain curve is plotted for the product prepared with a given bath composition and the electroforming process conditions. Alterations are then again made to the electroforming process conditions and/or the composition of the electroforming bath until the hysteresis of the stress-strain curve is maximized.

Figure 2:
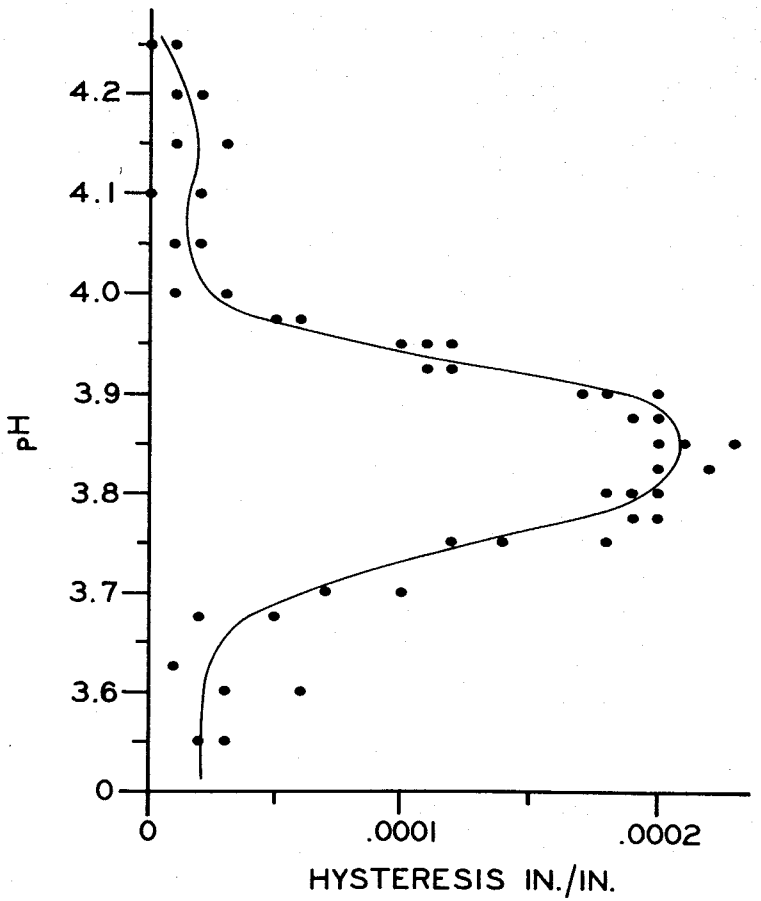
FIG. 2 graphically illustrates the effect of pH control on hysteresis.
Figure 3:
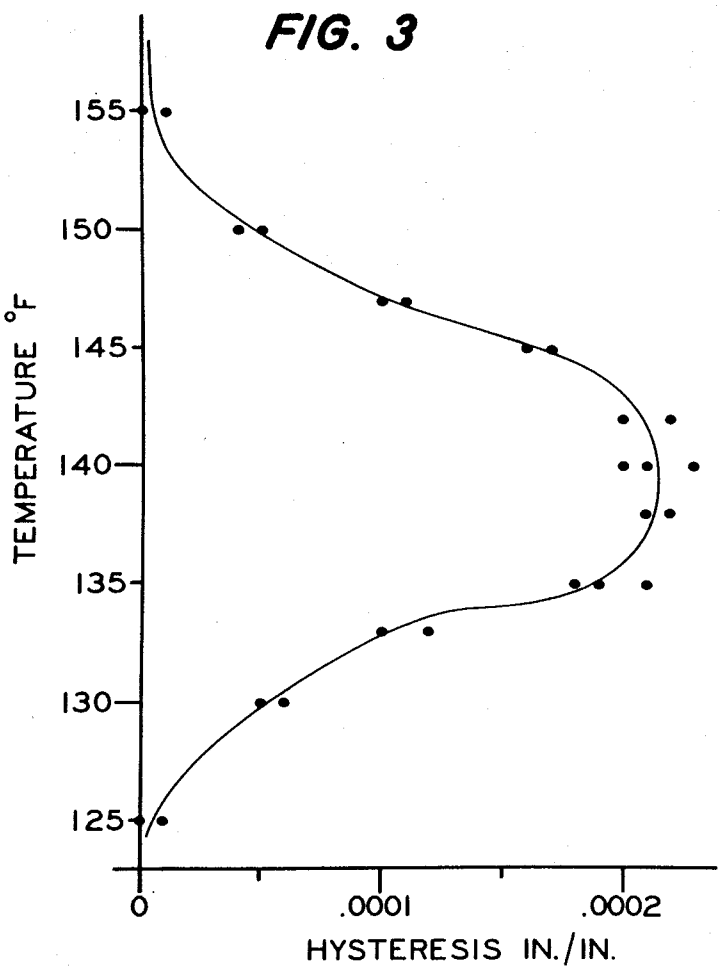
FIG. 3 graphically illustrates the effect bath temperature control on hysteresis.

When electroforming nickel in accordance with the process of this invention, the pH of the bath should be between about 3.75 and about 3.95 with optimum hysteresis characteristics being achieved at a pH of about 3.85. The important relationship of nickel bath pH control to hysteresis is illustrated in FIG. 2 in which the hysteresis characteristics of rectangular samples cut from electroformed nickel articles prepared on 1 inch diameter stainless steel (304) mandrels having a length of about 24 inches in different electroforming baths maintained at 140° F. and nickel concentration of 11.5 oz/gal but held at different pH values are plotted against the pH value of the bath in which each electroformed nickel article was made. A parting temperature of about 40° F. was employed. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in. between about 135° F. and about 145° F. with optimum hysteresis being achieved at a bath temperature of about 140° F. The important relationship of nickel bath temperature control to hysteresis is illustrated in FIG. 3 in which the hysteresis characteristics of rectangular samples from electroformed nickel articles prepared on 1 inch diameter stainless steel (304) mandrels in different electroforming baths maintained at pH 3.85 and nickel concentration of 11.5 oz/gal but held at different temperatures are plotted against the temperature of the bath in which each electroformed nickel article was made. A parting temperature of about 40° F. was employed. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in.

Figure 4:
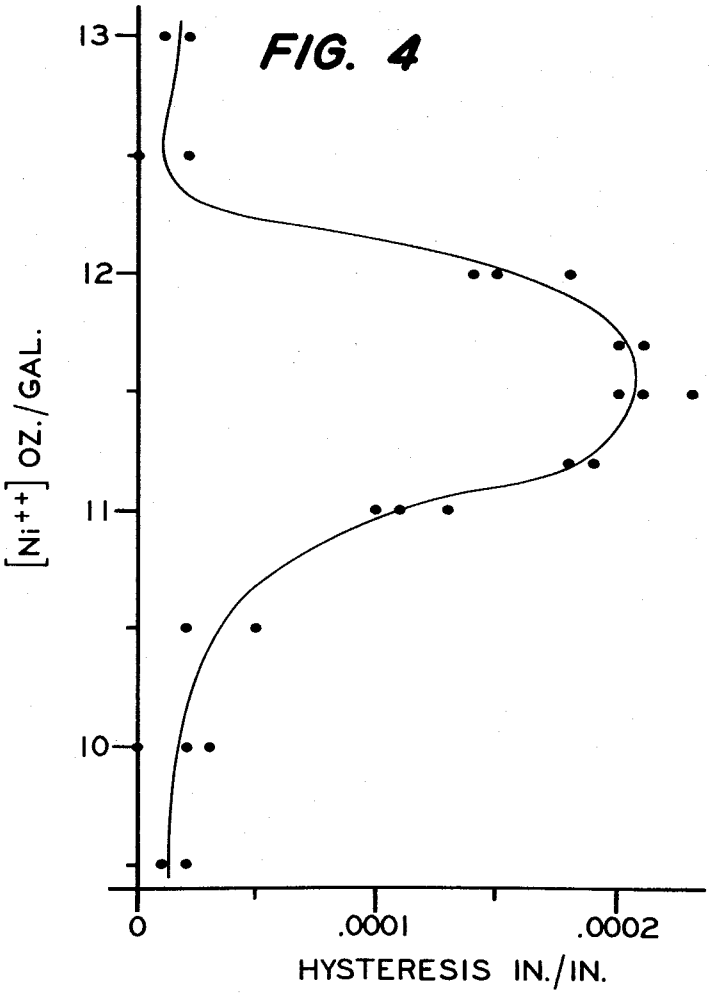
FIG. 4 graphically illustrates the effect of metal concentration control on hysteresis.

The preferred concentration of nickel for electroforming nickel articles should be between about 11 oz/gal and about 12 oz/gal with optimum being about 11.5. oz/gal. The important relationship of nickel concentration control to hysteresis is illustrated in FIG. 4 in which the hysteresis characteristics of rectangular samples from electroformed nickel articles prepared on 1 inch diameter stainless steel (304) mandrels in different electroforming baths maintained at pH 3.85 and temperature of 140° F. but held at different nickel concentrations are plotted against the nickel concentration of the bath in which each electroformed nickel article was made. A parting temperature of about 40° F. was employed. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in.

When the boric acid concentration drops below about 4 oz/gal, bath control diminishes and surface flaws increase. The boric acid concentration is preferably maintained at about the saturation point at 100° F. Optimum hysteresis may be achieved with a boric acid concentration of about 5 oz. per gallon. When the boric acid concentration exceeds about 5.4 oz/gal, precipitation can occur in localized cold spots thereby interfering with the electroforming process.

To minimize surface flaws such as pitting, the surface tension of the plating solution is adjusted to between about 33 dynes per square centimeter to about 37 dynes per square centimeter. The surface tension of the solution may be maintained within this range by adding an anionic surfactant such as sodium lauryl sulfate, sodium alcohol sulfate (Duponol 80, available from E. I. duPont de Nemours and Co., Inc.), sodium hydrocarbon sulfonate (Petrowet R, available from E. I. duPont de Nemours and Co., Inc.) and the like. Up to about 0.014 oz/gal of an anionic surfactant may be added to the electroforming solution. The surface tension in dynes per centimeter is generally about the same as that described in U.S. Pat. No. 3,844,906. The concentration of sodium lauryl sulfate is sufficient to maintain the surface tension at about 33 dynes per centimeter to about 37 dynes per centimeter.

Saccharine is a stress reliever. However, in a concentration of more than about 2 grams per liter, it causes nickel oxide to form as a green powder rather than as a nickel deposit on core mandrels. At concentrations of about 1 gram per liter the deposited nickel layer will often become so compressively stressed that the stress will be relieved during deposition causing the deposit to be permanently wrinkled. Consequently, one cannot depend on adding large quantities of saccharine or other stress reducers to an electroforming bath to produce the desired parting gap. Additionally, saccharine renders the deposit brittle thus limiting its uses The preferred current density is between about 300 amps per square foot and about 400 amps per square foot. Higher current densities may be achieved by increasing the electrolyte flow, mandrel rotational speed, electrolyte agitation, and cooling. Current densities as high as 900 amps per square foot have been demonstrated.

Parting conditions are also optimized by cooling the outer surface of the electroformed article rapidly to cool the entire deposited coating prior to any significant cooling and contracting of the core mandrel permanently deform the electroformed article. The rate of cooling should be sufficient to impart a stress in the electroformed article of between about 40,000 psi and about 80,000 psi to permanently deform the electroformed article and to render the length of the inner perimeter of the electroformed article incapable of contracting to less than 0.04 percent greater than the length of the outer perimeter of the core mandrel after the core mandel is cooled.

The difference in temperature between the coating and the outer cooling medium must be sufficiently less than the difference in temperature between the cooling medium and the temperature of the core mandrel during the stretching phase of the process to achieve sufficient permanent deformation of the electroformed article. Nickel has a low specific heat capacity and a high thermal conductivity. Thus, when an assembly of an electroformed cylindrical nickel article on a solid stainless steel core mandrel, such as 304 stainless steel, having a diameter of about 1 inch originally at a temperature of 140° F. is cooled by immersion in a liquid bath at a temperature of about 40° F., the temperature of the electroformed article may be dropped to 40° F. in less than 1 second whereas the mandrel itself requires 10 seconds to reach 40° F. after immersion. However, because of the rapid rate of cooling and contraction of thin walled core mandrels, an electroformed article cannot be removed from the mandrel by utilizing a cooling medium surrounding the outer surface of the electroformed article where the mandrel has a segmental cross-sectional area of less than about 1.8 square inches and an overall length to segmental cross-sectional area ratio greater than about 0.6.

The electroforming process of this invention may be conducted in any suitable electroforming device. For example, a solid cylindrically shaped mandrel may be suspended vertically in an electroplating tank. The mandrel is constructed of electrically conductive material that is compatible with the metal plating solution. For example, the mandrel may be made of stainless steel. The top edge of the mandrel may be masked off with a suitable non-conductive material, such as wax to prevent deposition. The mandrel may be of any suitable cross-section including circular, rectangular, triangular and the like. The electroplating tank is filled with a plating solution and the temperature of the plating solution is maintained at the desired temperature. The electroplating tank can contain an annular shaped annode basket which surrounds the mandrel and which is filled with metal chips. The annode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank and immersed in a cold water bath. The temperature of the cold water bath should be between about 80° F. and about 33° F. When the mandrel is immersed in the cold water bath, the deposited metal is cooled prior to any significant cooling and contracting of the solid mandrel to impart an internal stress of between about 40,000 psi and about 80,000 psi to the deposited metal. Since the metal cannot contract and is selected to have a stress-strain hysteresis of at least about 0.00015 in/in, it is permanently deformed so that after the core mandrel is cooled and contracted, the deposited metal article may be removed from the mandrel. The deposited metal article does not adhere to the mandrel since the mandrel is selected from a passive material. Consequently, as the mandrel shrinks after permanent deformation of the deposited metal, the deposited metal article may be readily slipped off the mandrel.

A suitable electroforming apparatus for carrying out the process described above except for use of a solid mandrel is described, for example, in British Pat. No. 1,288,717, published Sept. 13, 1972. The entire disclosure of this British Patent Specification is incorporated herein by reference.

A typical electrolytic cell for depositing metals such as nickel may comprise a tank containing a rotary drive means including a mandrel supporting drive hub centrally mounted thereon. The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Non sulfer depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

The present invention will become more apparent from the following discussion and drawing which provides a schematic flow diagram illustrating a nickel sulfamate solution treating loop.

Figure 5:
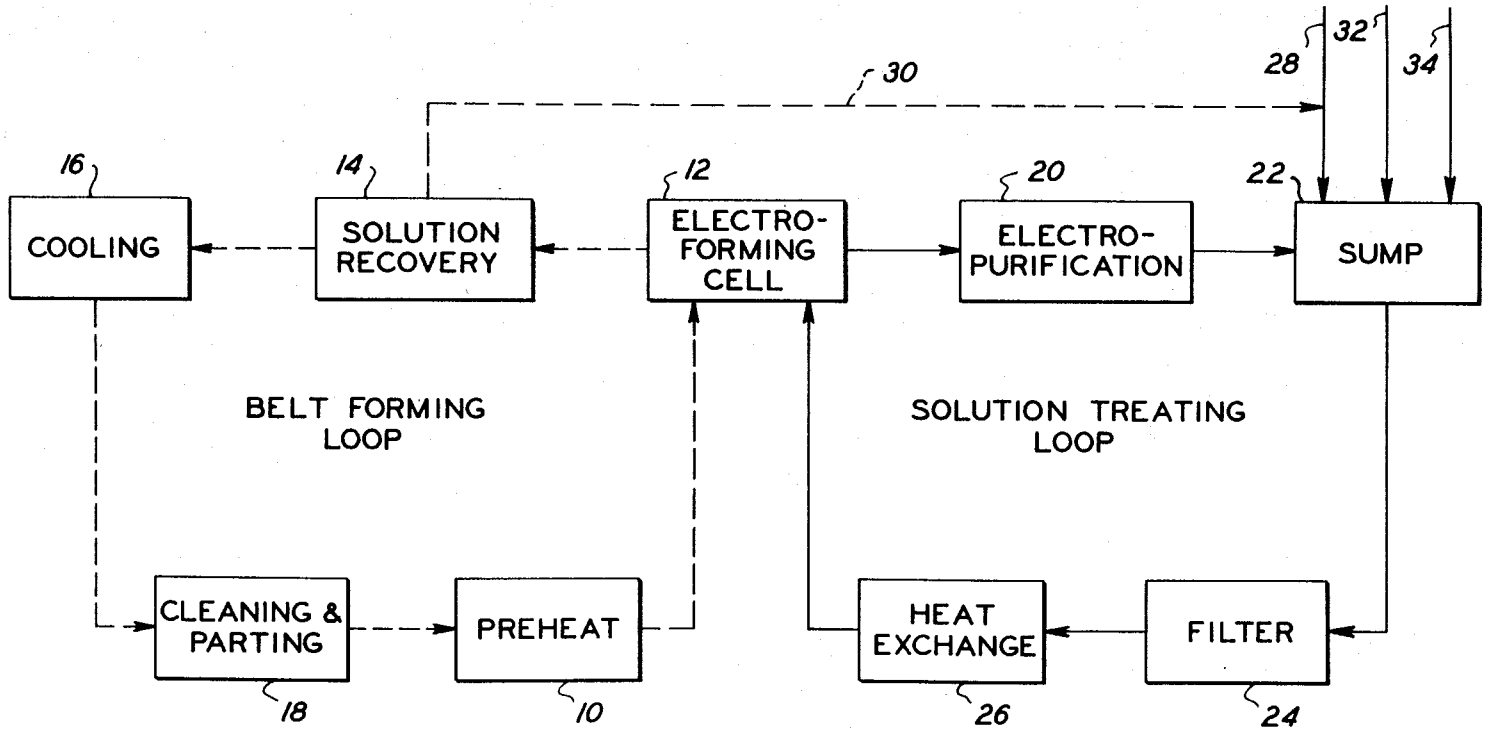
FIG. 5 graphically illustrates a flow chart of a series of processing stations for maintaining a steady state condition in an electroforming bath.

As shown in the FIG. 5, an article is electroformed by preheating a solid electrically conductive mandrel at a preheating station 10. Preheating is effected by contacting the mandrel with a nickel sulfamate solution at about 140° F. for a sufficient period of time to bring the solid mandrel to about 140° F. Preheating in this manner allows the mandrel to expand to the dimensions desired in the electroforming zone 12 and enables the electroforming operation to begin as soon as the mandrel is placed in the electroforming zone 12. Thereafter, the mandrel is transported from preheating station 10 to an electroforming zone 12. The electroforming zone 12 comprises at least one cell containing an upstanding electrically conductive rotatable spindle which is centrally located within the cell and a concentrically located container spaced therefrom which contains donor metallic nickel. The cell is filled with nickel sulfamate electroforming solution. The mandrel is positioned on the upstanding electrically conductive rotatable spindle and is rotated thereon. A DC potential is applied between the rotating mandrel cathode and the donor metallic nickel anode for a sufficient period of time to effect electrodeposition of nickel on the mandrel to a predetermined thickness of at least 30 Angstroms. Upon completion of the electroforming process, the mandrel and the nickel belt formed thereon are transferred to a nickel sulfamate solution recovery zone 14. Within this zone, a major portion of the electroforming solution dragged out of the electroforming cell is recovered from the belt and mandrel. Thereafter, the electroformed article-bearing mandrel is transferred to a cooling zone 16 containing water maintained at about 40° F.

to 80° F. or cooler for cooling the mandrel and the electroformed article whereby the electroformed article is rapidly cooled prior to any significant cooling and contracting of the solid mandrel whereby a stress of between about 40,000 psi and about 80,000 psi are imparted to the cooled electroformed article to permanently deform the electroformed article and to render the length of the inner perimeter of the electroformed article incapable of contracting to less than about 0.4 percent greater than the length of the outer perimeter of the core mandrel after the core mandrel is cooled and contracted. Cooling is then continued to cool and contract the solid mandrel. After cooling, the mandrel and electroformed article are passed to a parting and cleaning station 18 at which the electroformed article is removed from the mandrel, sprayed with water and subsequently passed to a dryer (not shown). The mandrel is sprayed with water and checked for cleanliness before being recycled to preheat station 10 to commence another electroforming cycle. The relatively electroformed articles by the present invention must have a stress-strain hysteresis of at least about 0.00015 in/in. Moreover, the electroformed article must have an internal stress of between about 1,000 psi and about 15,000 compressive, i.e.

$$0 \quad {}^{+1{,}000}_{-15{,}000} \quad \text{psi,}$$

to permit rapid parting of the electroformed article from the mandrel. The electroformed article must have a thickness of at least about 30 Angstroms in order to allow sufficient permanent deformation utilizing the stress-strain hysteresis characteristics of the electroformed article.

Very high current densities are employed with a nickel sulfamate electroforming solution. Generally, the current densities range from about 150 amps per square foot to about 500 amps per square foot, with a preferred current density of about 300 amps per square foot. Generally, current concentrations range from about 5 to about 20 amps per gallon.

At the high current density and high current concentration employed in the process of this invention, a great deal of heat is generated in the metal or metal alloy electroforming solution within the electroforming cell. This heat must be removed in order to maintain the solution temperature within the cell in the range of about 135° F. to about 145° F., and preferably at about 140° F. At temperatures below about 135° F., there is a sufficient decrease in the desired stress strain hysteresis needed for removal of the electroformed nickel article from the mandrel without damaging the mandrel or the article. At temperatures of above about 160° F., hydrolysis of the nickel sulfamate occurs under the acid conditions maintained in the solution resulting in the generation of $NH_4^+$ which is detrimental to the process as it increases tensile stress and reduces ductility in the nickel belt.

Because of the significant effects of both temperature and solution composition on the final product as discussed herein, it is necessary to maintain the electroforming solution in the constant state of agitation thereby substantially precluding localized hot or cold spots, stratification and inhomogeneity in the composition. Moreover, constant agitation continuously exposes the mandrel to fresh solution and, in so doing, reduces the thickness of the cathode film thus increasing the rate of diffusion through the film and thus enhancing nickel deposition. Agitation is maintained by continuous rotation of the mandrel and by impingement of the solution of the mandrel and cell walls as the solution is ciculated through the system. Generally, the solution flow rate across the mandrel surface can range from about 4 linear feet per second to about 10linear feet per second. For example, at a current density of about 300 amps per square foot with a desired solution temperature range within the cell of about 138° F. to about 142° F., a flow rate of about 20 gal/min of solution has been found sufficient to effect proper temperature control. The combined effect of mandrel rotation and solution impingement assures uniformity of composition and temperature of the electroforming solution within the electroforming cell.

For continuous, stable operation to achieve a stress-strain hysteresis of at least about 0.00015 in/in, the composition of the aqueous nickel sulfamate solution within the electroforming zone should be as follows:

| | |
|---|---|
| Total nickel | 11 to 12 oz/gal |
| $H_3BO_3$ | 4 to 5 oz/gal |
| pH | 3.80 to 3.90 |
| Surface Tension | 33 to 37 dynes/cm$^2$ |

A metal halide, generally a nickel halide such as nickel chloride, nickel bromide, or nickel fluoride and preferably, nickel chloride, are included in the nickel sulfamate electroforming solution to avoid anode polarization. Anode polarization is evidenced by gradually increasing pH.

The pH of the nickel electroforming solution should be between about 3.8 and about 3.9. At a pH of greater than about 4.1 surface flaws such as gas pitting increase. Also, internal stress increases and interfers with parting of the electroformed belt from the mandrel. At a pH of less than about 3.5, the metallic surface of the mandrel can become activated, especially when a chromium plated mandrel is employed, thereby causing the metal electroformed to adhere to the chromium plating. Low pH also results in lower tensile strengh. The pH level may be maintained by the addition of an acid such as sulfamic acid, when necessary.

Control of the pH range may also be assisted by the addition of a buffering agent such as boric acid within a range of about 4 oz/gal to about 5 oz/gal.

In order to maintain a continuous steady state operation, the nickel sulfomate electroforming solution is continuously circulated through a closed solution treating loop as shown in FIG. 5. This loop comprises a series of processing stations which maintain a steady state composition of the solution, regulate the temperature of the solution and remove any impurities therefrom.

The electroforming cell 12 contains one wall thereof which is shorter than the others and acts as a weir over which the electroforming solution continuously overflows to a trough as recirculating solution is continuously pumped into the cell via the solution distributor manifold or sparger along the bottom of the cell. The solution flows from the electroforming cell 12 via a trough to an electropurification zone 20 and a solution sump 22. The solution is then pumped to a filtration zone 24 and to a heat exchange station 26 and is then recycled in purified condition at a desired temperature and composition to the electroplating cell 12 whereupon that mixture with the solution contained therein in a steady state condition set forth above are maintained on a continuous and stable basis.

The electrolytic station 20 removes the dissolved nobel metallic impurities from the nickel sulfamate solution prior to filtering. A metal plate of steel, or preferably stainless steel, can be mounted in station 20 to function as the cathode electrode. Anodes can be provided by a plurality of anode baskets which comprise tubular shaped metallic bodies, preferably titanium, each having a fabric anode bag. A DC potential is applied between the cathodes and the anodes of the purification station from a DC source. The electropurifiation station 20 includes a wall which extends coextensively with the wall of the solution sump zone 22 and functions as a weir.

The solution can be replenished by the automatic addition of deionized water from a source 28 and/or by recycling solution from the nickel rinse zone 14 to sump 22 via line 30. A pH meter can be positioned in sump 22 for sensing the pH of the solution and for effecting the addition of an acid such as sulfamic acid when necessary to maintain essentially constant pH. The continuous addition of stress reducing agents can be effected at sump 22 via line 32. Also, control of the surface tension of the solution can be maintained by continuous addition of surfactant to the sump via line 34.

The electroforming solution which flows from the cell 12 is raised in temperature due to the flow of relatively large currents therein and accompanying generation of heat in the electroforming cell. Means may be provided at the heat exchanging station 26 for cooling the electroforming solution to a lower temperature. The heat exchanger may be of any conventional design which receives a coolant such as chilled water from a cooling or refrigerating system (not shown). The electroplating solution which is cooled in the heat exchanger means can be successively pumped to a second heat exchanger which can increase the temperature of the cool solution to within relatively close limits of the desired temperature. The second heat exchanger can be heated by steam derived from a steam generator (not shown). The first cooling heat exchanger can, for example, cool the relatively warm solution from a temperature of about 145° F. or above to a temperature of about 135° F. A second warming heat exchange can heat the solution to a temperature of 140° F. The efflux from the heat exchange station 26 is pumped to the electroforming cell 12.

By manipulating the bath parameters such as the addition of enhancers, altering pH, changing the temperatures, adjusting the cation concentration of the electroforming bath, regulating current density, one may alter the stress-strain hysteresis of the electroformed article. Thus the conditions are experimentally altered until a deposited electroformed article is characterized by a stress-strain hysteresis of at least about 0.00015 in/in. For example, when electroforming nickel, the relative quantity of enhancers such as saccharine, methylbenzene sulfonamide, the pH, the bath temperature, the nickel cation concentration, and the current density may be adjusted to achieve a stress-strain hysteresis of at least about 0.00015 in/in. Current density affects the pH and the nickel concentration. Thus, if the current density increases, the nickel is unable to reach the surface of the core mandrel at a sufficient rate and the ½ cell voltage increases and hydrogen ions deposit thereby increasing the hydroxyl ions remaining in the bath thereby increasing the pH. Moreover, increasing the current density also increases the bath temperature.

In order to achieve a sufficient parting gap with hollow electroformed articles having a segmental cross-sectional area less than about 1.8 square inches and an overall length to segmental cross-sectional area ratio greater than about 0.6, the electroformed coating should have a thickness of at least about 30 Angstroms and a stress strain hysteresis of at least about 0.00015 in/in. Moreover, the exposed surface of the electroformed article on the mandrel must be rapidly cooled prior to any significant cooling and contracting of the core mandrel.

DESCRIPTION OF PREFERRED EMBODIMENTS

The following examples further define, describe and compare exemplary methods of preparing the electoformed articles of the present invention. Parts and percentages are by weight unless otherwise indicated. The examples, other than the control examples, are also intended to illustrate the various preferred embodiments of the present invention. Unless indicated otherwise, all mandrels are cylindrically shaped with sides parallel to the axis.

EXAMPLES I–IV

Except as noted in the Examples, the general process conditions for the following first four Examples were constant and are set forth below:

| | |
|---|---|
| Current Density | 285 - amps/ft$^2$ |
| Agitation Rate (linear ft/sec solution flow over the cathode surface) | 4–6 |
| pH | 3.8–3.9 |
| Surface Tension | 33–39 |
| $H_3BO_3$ | 4–5 oz/gal |
| Sodium Lauryl Sulfate | 0.0007 oz/gal |

| | EXAMPLE I |
|---|---|
| Mandrel Core | stainless steel (304) |
| Mandrel Perimeter (inches) | 2.355 |
| Mandrel Length (inches) | 23 |
| Ni (oz/gal) | 11.5 |
| $NiCl_2.6H_2O$ (oz/gal) | 6 |
| Anode | electrolytic |
| Plating Temp. (°F.) $T_2$ | 140 |
| Delta T ($T_2 - T_1$) | 100 |
| Parting Gap (in.) at | 0.00026 |
| $T_1$ (Parting Temp.-°F.) | 40 |
| Saccharin Concentration | 0 |
| 2-MBSA/Saccharine | 0 |
| Mole Ratio - Saccharine/Ni | 0 |
| Surface Roughness (micro inches, RMS) | 4 |
| Internal Stress, psi | −3,000 |
| Tensile Strength, psi | 93,000 |
| Elongation (percent in 2 in) | 12 |
| Results - Excellent parting of the electroformed article from the madrel was observed. | |

| | EXAMPLE II |
|---|---|
| Mandrel Core | aluminum |
| Mandrel Perimeter (inches) | 2.355 |
| Mandrel Length (inches) | 23 |
| Ni (oz/gal) | 11.5 |

-continued

| | EXAMPLE II |
|---|---|
| $NiCl_2.6H_2O$ (oz/gal) | 6 |
| Anode | electrolytic |
| Plating Temp. (°F.) $T_2$ | 140 |
| Delta T ($T_2 - T_1$) | 100 |
| Parting Gap (in.) at | 0.00055 |
| $T_1$ (Parting Temp. °F.) | 40 |
| Saccharin Concentration | 0 |
| 2-MBSA/Saccharine | 0 |
| Mole Ratio - Saccharine/Ni | 0 |
| Surface Roughness (micro inches, RMS) | 4 |
| Internal Stress, psi | −3,000 |
| Tensile Strength, psi | 93,500 |
| Elongation (percent in 2 in) | 13 |
| Results - The mandrel was bent during attempt to part the electroformed article from the mandrel. | |

| | EXAMPLE III |
|---|---|
| Mandrel Core | Inconel |
| Mandrel Perimeter (inches) | 1.5 (0.25 × 0.5 rectangular) |
| Mandrel Length (inches) | 23 |
| Ni (oz/gal) | 11.5 |
| $NiCl_2.6H_2O$ (oz/gal) | 6 |
| Anode | electrolytic |
| Plating Temp. (°F.) $T_2$ | 140 |
| Delta T ($T_2 - T_1$) | 100 |
| Parting Gap (in.) at | 0.00018 |
| $T_1$ (Parting Temp.-°F.) | 40 |
| Saccharin Concentration | 0 |
| 2-MBSA/Saccharine | 0 |
| Mole Ratio - Saccharine/Ni | 0 |
| Surface Roughness (micro inches, RMS) | 4 |
| Internal Stress, psi | −3,000 |
| Tensile Strength, psi | 94,000 |
| Elongation (percent in 2 in) | 13 |
| Results - Excellent parting of the electroformed article from the madrel was observed. | |

| | EXAMPLE IV |
|---|---|
| Mandrel Core | Titanium with 2% Paladium |
| Mandrel Permeter (inches) | 2.355 |
| Mandrel Length (inches) | 23 |
| Ni (oz/gal) | 11.5 |
| $NiCl_2.6H_2O$ (oz/gal) | 6 |
| Anode | electrolytic |
| Plating Temp. (°F.) $T_2$ | 140 |
| Delta T ($T_2 - T_1$) | 100 |
| Parting Gap (in.) at | 0.00022 |
| $T_1$ (Parting Temp.-°F.) | 40 |
| Saccharin Concentration | 0 |
| 2-MBSA/Saccharine | 0 |
| Mole Ratio - Saccharine/Ni | 0 |
| Surface Roughness (micro inches, RMS) | 4 |
| Internal Stress, psi | −3,000 |
| Tensile Strength, psi | 94,000 |
| Elongation (percent in 2 in) | 12 |
| Results - Fair parting of the electroformed article from the madrel was observed. | |

EXAMPLES IV—IV

Experimental runs conducted under the conditions described in the working examples of U.S. Pat. No. 3,844,906 revealed that the electroformed articles prepared in the working examples of the patent and described below exhibited little or no stress-strain hysteresis characteristics. The process described in U.S. Pat. No. 3,844,906 and the process of this invention are compared below:

| | EXAMPLE | | |
|---|---|---|---|
| | V 3,844,906 (Example 2) | VI Invention | VII Invention |
| Current Density (amps/ft$^2$) | 300 | 300 | 300 |
| Agitation Rate (linear ft/sec solution flow over cathode surface) | 6 | 6 | 6 |
| pH | 4.0 | 4.0 | 3.85 |
| Surface Tension (dynes/cm) | 35 | 35 | 35 |
| $H_3BO_3$ (oz/gal) | 5 | 5 | 5 |
| Sodium Lauryl Sulfate (oz/gal) | 0.0007 | 0.0007 | 0.0007 |
| Mandrel Perimeter (in) | 65 | 3.142 | 3.142 |
| Mandrel Core | Al | Al | Stainless Steel (304) |
| Mandrel Configuration | Hollow | Solid | Solid |
| Mandrel Length (inches) | 21 | 24 | 24 |
| Ni (oz/gal) | 10 | 10 | 10 |
| $NiCl_2.6H_2O$ (oz/gal) | 1.2 | 1.2 | 1.2 |
| Anode | SDNi | SDNi | SDNi |
| Plating Temp. (°F.) $T_2$ | 140 | 140 | 140 |
| Delta T ($T_2 - T_1$) | 75 | 75 | 75 |
| $T_1$ (Parting Temp. - °F. | 65 | 65 | 65 |
| Parting Gap (in.) at $T_1$ | 0.003 | 0.000113 | 0.00018 |
| Saccharin Concentration (Mg/l) | 0 | 0 | 0 |
| Wt Ratio 2-MBSA/Saccharine | — | — | — |
| Mole Ratio Saccharine/Ni | | | |
| Surface Roughness (micro inches, RMS) | 13–17 | 13–17 | 13–17 |
| Internal Stress, (psi) | +6,000 | +6,000 | +6,000 |
| Tensile Strength, (psi) | 100,000 | 100,000 | 100,000 |
| Elongation (percent in 2 in) | 10 | 10 | 10 |
| Results | Article not partable from Mandrel. | Article not partable from Mandrel. | Good Parting Mandrel Undamaged. |

| | EXAMPLE | | |
|---|---|---|---|
| | VIII 3,844,906 (Example 10) | IX Invention | X Invention |
| Current Density (amps/ft$^2$) | 300 | 300 | 300 |
| Agitation Rate (linear ft/sec solution flow over cathode surface) | 6 | 6 | 6 |
| pH | 4.0 | 4.0 | 3.85 |
| Surface Tension (dynes/cm) | 35 | 35 | 35 |
| $H_3BO_3$ (oz/gal) | 5 | 5 | 5 |
| Sodium Lauryl Sulfate (oz/gal) | 0.0007 | 0.0007 | 0.0007 |
| Mandrel Core | Al | Stainless Steel (304) | Stainless Steel (304) |
| Mandrel Permeter (in) | 65 | 3.142 | 3.142 |
| Mandrel Configuration | Hollow | Solid | Solid |
| Mandrel Length (inches) | 21 | 24 | 24 |
| Ni (oz/gal) | 15 | 15 | 11.5 |
| $NiCl_2.6H_2O$ (oz/gal) | 1.75 | 1.75 | 1.75 |
| Anode | SDNi | SDNi | SDNi |
| Plating Temp. (°F.) $T_2$ | 150 | 150 | 140 |
| Delta T ($T_2 - T_1$) | 75 | 75 | 75 |
| $T_1$ (Parting | 75 | 75 | 75 |

-continued

| | EXAMPLE | | |
|---|---|---|---|
| | VIII 3,844,906 (Example 10) | IX Invention | X Invention |
| Temp. - °F.) | | | |
| Parting Gap (in.) at $T_1$ | 0.012 | 0.0001 | 0.0028 |
| Saccharin Concentration (Mg/l) | 20 | 20 | 20 |
| Wt Ratio 2-MBSA/Saccharine | 3 | 3 | 3 |
| Mole Ratio Saccharine/Ni | $1.5 \times 10^{-4}$ | $1.5 \times 10^{-4}$ | $1.5 \times 10^{-4}$ |
| Surface Roughness (micro inches, RMS) | 65-80 | 65-80 | 7-10 |
| Internal Stress, (psi) | −4,000 | −4,000 | −8,000 |
| Tensile Strength, (psi) | 150,000 | 150,000 | 125,000 |
| Elongation (percent in 2 in) | 2 | 2 | 2 |
| Results | Excellent parting. Mandrel undamaged. | Poor parting. from Mandrel. | Excellent parting. Mandrel undamaged. |

| | EXAMPLE | | |
|---|---|---|---|
| | XI 3,844,906 (Example 14) | XII Invention | XIII Invention |
| Current Density (amps/ft$^2$) | 300 | 300 | 300 |
| Agitation Rate (linear ft/sec solution flow over cathode surface) | 6 | 6 | 6 |
| pH | 4.0 | 4.0 | 3.85 |
| Surface Tension (dynes/cm) | 35 | 35 | 35 |
| $H_3BO_3$ (oz/gal) | 5 | 5 | 5 |
| Sodium Lauryl Sulfate (oz/gal) | 0.0007 | 0.0007 | 0.0007 |
| Mandrel Core | Al | Stainless Steel (304) | Stainless Steel (304) |
| Mandrel Perimeter (in) | 65 | 3.142 | 3.142 |
| Mandrel Configuration | Hollow | Solid | Solid |
| Mandrel Length (inches) | 21 | 24 | 24 |
| Ni (oz/gal) | 13.5 | 13.5 | 11.5 |
| $NiCl_2.6H_2O$ (oz/gal) | 1.6 | 1.6 | 1.6 |
| Anode | SDNi | SDNi | SDNi |
| Plating Temp. (°F.) $T_2$ | 150 | 150 | 140 |
| Delta T ($T_2 - T_1$) | 75 | 75 | 100 |
| $T_1$ (Parting Temp. - °F.) | 75 | 75 | 40 |
| Parting Gap (in.) at $T_1$ | 0.012 | 0.00008 | 0.00028 |
| Saccharin Concentration (Mg/l) | 15 | 15 | 15 |
| Wt Ratio 2-MBSA/Saccharine | 2.3 | 2.3 | 2.3 |
| Mole Ratio Saccharine | $1.4 \times 10^{-4}$ | $1.4 \times 10^{-4}$ | $1.4 \times 10^{-4}$ |
| Surface Roughness (micro inches, RMS) | 43-55 | 43-55 | 10-15 |
| Internal Stress, (psi) | −3,000 | −3,000 | −7,000 |
| Tensile Strength, (psi) | 110,000 | 110,000 | 98,000 |
| Elongation (percent in 2 in) | 7 | 7 | 10 |
| Results | Excellent parting. Mandrel undamaged. | Poor parting. Scratched Mandrel. | Excellent parting. Mandrel undamaged. |

Although the invention has been described with reference to specific preferred embodiments, it is not intended to be limited thereto, rather those skilled in the art will recognize that variations and modifications may be made therein which are within the spirit of the invention and within the scope of the claims.

I claim:

1. An electroforming process comprising providing a core mandrel having an electrically conductive, abhesive outer surface, a coefficient of expansion of at least about $8\times10^{-5}$ in./in./°F., a segmental cross-sectional area of less than about 1.8 square inches and an overall length to segmental cross-sectional area ratio greater than about 0.6, establishing an electroforming zone between an anode selected from a metal and alloys thereof having a coeficient of expansion of between about $6\times10^{-6}$ in./in./°F. and about $10\times10^{-6}$ in./in./°F. and a cathode comprising said core mandrel, said cathode and said anode being separated by a bath comprising a salt solution of said metal, heating said bath and said cathode to a temperature sufficient to expand the cross-sectional area of said mandrel, applying a ramp current across said cathode and said anode to electroform a coating of said metal on said core mandrel, said coating having a thickness at least about 30 Angstroms and stress-strain hysteresis of at least about 0.00015 in./in., rapidly applying a cooling fluid to the exposed surface of said coating to cool said coating prior to any significant cooling and contracting of said core mandrel whereby a stress of between about 40,000 p.s.i. and about 80,000 p.s.i. are imparted to the cooled coating to permanently deform said coating and to render the length of the inner perimeter of said coating incapable of contracting to less than 0.04 percent greater than the length of the outer perimeter of said core mandrel after said core mandrel is cooled and contracted, cooling and contracting said core mandrel, and removing said coating from said core mandrel.

2. An electroforming process according to claim 1 wherein said overall length to segmental cross-sectional area ratio greater than about 6.

3. An electroforming process according to claim 1 wherein said core mandrel has a taper of less than 0.001 inch per foot along the length of said core mandrel.

4. An electroforming process according to claim 1 wheren said core mandrel is solid.

5. An electroforming process according to claim 1 wherein said core mandrel has a thermal coefficient of expansion less than about the thermal coefficient of expansion of said coating.

6. An electroforming process according to claim 5 wherein said coating has a thermal coefficient of expansion of less than about $8\times10^{-5}$ in./in./°F.

7. An electroforming process according to claim 1 wherein said core mandrel is stainless steel.

8. An electroforming process according to claim 1 wherein said coating is nickel.

9. An electroforming process according to claim 8 wherein the pH of said bath is maintained at between about 3.75 and about 3.95 while applying said ramp current across said cathode and said anode.

10. An electroforming process according to claim 8 wherein the pH of said bath is maintained at about 3.85 while applying said ramp current across said cathode and said anode.

11. An electroforming process according to claim 8 wherein the temperature of said bath is maintained at between about 135° F. and about 145° F. while applying said ramp current across said cathode and said anode.

12. An electroforming process according to claim 8 wherein the temperature of said bath is maintained at about 140° F. while applying said ramp current across said cathode and said anode.

13. An electroforming process according to claim 8 wherein the concentration of nickel in said bath is maintained at between about 11 oz/gal and about 12 oz/gal while applying said ramp current across said cathode and said anode.

14. An electroforming process according to claim 13 wherein the pH of said bath is maintained at between about 3.75 and about 3.95, the temperature of said bath is maintained at between about 135° F. and about 145° F. and the concentration of nickel in said bath is maintained at between about 11 oz/gal and about 12 oz/gal while applying said ramp current across said cathode and said anode.

15. An electroforming process according to claim 8 wherein the current density is maintained at least about 300 amps/$ft^2$ while applying said ramp current across said cathode and said anode.

* * * * *

UNITED STATES PATENT AND TRADEMARK OFFICE

CERTIFICATE OF CORRECTION

PATENT NO . 4,501,646

DATED : February 26, 1985

INVENTOR(S) : William G Herbert

It is certified that error appears in the above--identified patent and that said Letters Patent is hereby corrected as shown below:

Title page, item [57], col. 2,

Abstract, line 4, change "$8 \times 10^{-5}$" to -- $8 \times 10^{-6}$ --.

Col. 18,

Claim 1, line 4, change "$8 \times 10^{-5}$" to -- $8 \times 10^{-6}$ --.

Signed and Sealed this

Fifteenth Day of March, 1994

*Attest:*

Bruce Lehman

BRUCE LEHMAN

*Attesting Officer*

*Commissioner of Patents and Trademarks*